United States Patent [19]

Sandström et al.

[11] 4,293,304

[45] Oct. 6, 1981

[54] FLEXIBLY MOUNTED DRIVE ARRANGEMENT FOR SHIPS

[75] Inventors: Anders Sandström, Nynäshamn, Sweden; Erich Aucktor, Offenbach, Fed. Rep. of Germany

[73] Assignee: Scatra Ab, Nynäshamn, Sweden

[21] Appl. No.: 954,117

[22] Filed: Oct. 24, 1978

[30] Foreign Application Priority Data

Oct. 28, 1977 [DE] Fed. Rep. of Germany ..... 2748359

[51] Int. Cl.[3] ..... B63H 1/14; B63H 5/06

[52] U.S. Cl. ..... 440/83; 440/52; 440/75; 64/21

[58] Field of Search ..... 64/21; 403/57, 56, 114; 115/34 R, 35, 74, 76, 900, 37; 114/269; 440/52, 75, 83, 111, 112

[56] References Cited

U.S. PATENT DOCUMENTS

| | | | |
|---|---|---|---|
| 3,428,017 | 2/1969 | Altson | 115/34 R |
| 3,572,281 | 3/1971 | Becker | 115/35 |
| 3,942,466 | 3/1976 | Bunyan | 115/34 R |
| 4,116,020 | 9/1978 | Aucktor | 64/21 |

*Primary Examiner*—Trygve M. Blix
*Assistant Examiner*—D. W. Keen

[57] ABSTRACT

In a drive arrangement for a ship, a flexibly mounted drive unit provides the torque for a propeller shaft. The propeller shaft can be supported in a flexibly mounted thrust bearing. A drive shaft interconnecting the drive unit and the propeller shaft includes a single length rigid shaft with a constant velocity universal joint at each end. At least one of the universal joints can absorb axial movement while both can absorb angular movement. The drive unit may consist of a drive motor or the combination of a drive motor and a reduction gear unit interconnected by a rigid shaft with a constant velocity universal joint at each of its ends.

6 Claims, 6 Drawing Figures

FLEXIBLY MOUNTED DRIVE ARRANGEMENT FOR SHIPS

SUMMARY OF THE INVENTION

The present invention is directed to a drive arrangement for ships in which a flexibly mounted drive unit consisting of a motor or of a motor and a gear unit is connected over a drive shaft to a propeller shaft with the drive shaft transmitting torque to a propeller.

In such drive arrangements the flexible mounting of the entire drive unit including the propulsion means has been suggested to reduce vibration and sound transmissions, note German Pat. No. 727,059. In such arrangements it is possible to mount the entire drive unit including its drive shaft in a flexible manner, however, there is the disadvantage that it is necessary to provide a rigid, exactly aligned connection between the motor and the propeller, since otherwise the uniform running of the system is significantly disturbed. Since the entire system must be mounted in the ship's body in exact alignment, it requires a significant amount of space.

Furthermore, there is another known drive arrangement, note German Pat. No. 440,269, where an exactly aligned, rigid connection between the drive unit and the propeller is required. This arrangement also requires an exact and precise alignment with the ship's body. The vibrations occurring in such arrangements must be damped so that they are not transmitted to the ship's body and, thus, generate vibrations and excessively loud noise. In yet another known drive arrangement, note German Pat. No. 2,330,832, for reducing vibration, a reduction gearing is mounted in a stepped bearing, however, in that arrangement the exact alignment of the drive shaft is necessary to afford quiet running operation. Even if universal joint shafts were used in this case, the joints would have to be arranged so that the drive shaft and driven shaft is in aligned or parallel relation to one another to avoid developing a non-uniform running action because of the universal joint shaft. The entire prior art has the disadvantage that, due to the special requirements for alignment, a significant amount of space is required. Accordingly, the designer is limited in the selection of the arrangement within the ship's body. The useful space is reduced and the disadvantage of vibration must be accepted.

Therefore, in view of the disadvantages experienced in the prior art, it is the object of the present invention to provide a quiet running drive arrangement, that is, one which essentially eliminates the transmission of any vibrations in the drive unit and the propeller and, moreover, reduces the space required, that is, allows the ship designer to better utilize the available space without negatively affecting the quiet running operation of the ship. Moreover, it is possible that the individual parts of the drive arrangement do not need to be aligned.

In accordance with the present invention, the components of the drive unit, particularly the gear unit and/or motor, are flexibly mounted in the ship's body and the drive shaft connecting the drive motor and the propeller shaft and, additionally, the shaft connecting the motor and the gear unit, are constructed as constant velocity universal joint shafts each consisting of two constant velocity universal joints arranged at the ends of a rigid shaft which shaft is not adjustable in length, that is it has a single length.

A particular advantage of this drive arrangement is that it is not necessary to align the drive unit, that is the drive motor or the drive motor and gear unit, with the propeller shaft, since by using constant velocity universal joints a uniform running operation is assured even when the deflection angles are not equal. The individual components of the drive unit can be arranged in accordance with the available space so that the drive shaft is not in alignment with the longitudinal axis of the ship's body, rather it is arranged at a selected angle to the axis. Furthermore, the individual components of the drive unit can be flexibly mounted so that vibration is not transmitted to the ship's body. Moreover, it is of no importance for uniform running operation whether the vibration of the flexibly mounted components causes the angles of the shafts to be constantly changed during operation. Such angular variations are compensated by the universal joint shaft. The primary advantage resides in the use of a drive shaft formed of an intermediate rigid shaft with a constant velocity universal joint at each end affording three dimensional freedom of movement. In such an arrangement it is possible to mount the individual components differently so that additional space is gained which can benefit the overall design of the ship. Such a drive arrangement is preferable for use in smaller boats since the small space requirement can be best utilized or the available space can be increased by arranging the components in such a manner that their axes do not need to be in alignment.

In accordance with another feature, at least one of the constant velocity universal joints of the shaft is arranged to compensate for movement in the axial direction.

By virtue of this arrangement of flexibly mounted units with an interconnecting shaft providing uniform running operation, the motor noises are not transmitted to the ship in the manner of sound conducted through solid material. As a result of the flexible mounting of the components of the drive unit, the permanently oscillating movement is absorbed by the constant velocity universal joints without any significant axial forces, that is in a rolling manner and without any significant wear in the axial direction. Accordingly, an optimum noise reduction is achieved and alignment of the drive units is unnecessary. When each end of the shaft has a universal joint capable of absorbing axial movements, such movements can be absorbed proportionately in each joint.

Another feature of the invention is the support of the propeller shaft in a flexibly mounted thrust bearing.

In accordance with the present invention, all of the components of the drive unit can be flexibly mounted and, as a result, noise and vibration are reduced to a minimum, since the components are no longer rigidly connected to the ship's body. Moreover, any influence on the propeller due to these components is avoided.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
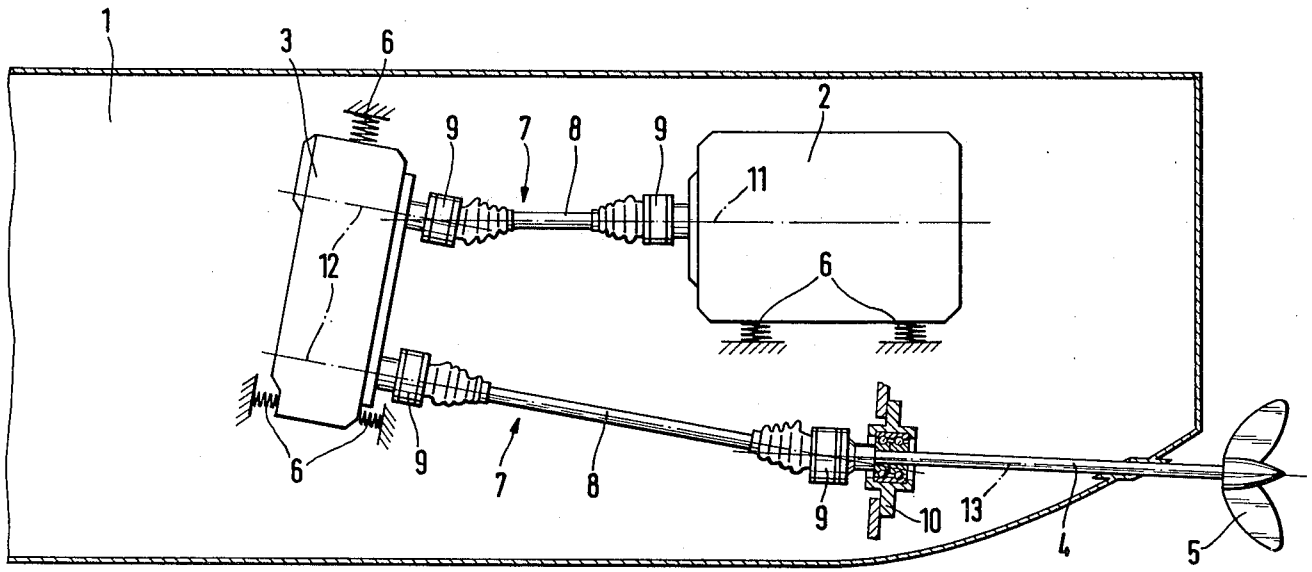
FIG. 1 is a schematic illustration of a portion of a ship's body, shown in section, including a drive motor, a reduction gear unit, and a propeller shaft to which the driving force is transmitted through two universal joint shafts.

FIG. 1 provides a schematically illustrated ship's body having a drive arrangement consisting of a drive motor 2, a reduction gear unit 3 and a propeller 5 connected to an axially elongated propeller shaft 4. The motor 2 and the gear unit 3 are flexibly mounted in the ship's body 1 by bearings 6. Both of these components of the drive unit can move relative to the ship's body 1 and such movements between the motor 2 and the gear unit 3 are compensated by a universal joint shaft 7. Universal joint shaft 7 consists of a rigid connecting shaft 8 with a constant velocity universal joint 9 at each end of the shaft. These universal joints 9 can be either joints capable of absorbing both angular and axial movement or merely angular movement or one of the shafts can merely afford angular movement while the other provides for both angular and axial movement. As a result, three dimensional movement is possible between the drive motor 2 and the gear unit 3. From the gear unit 3 another universal joint shaft 7 extends into connection with a thrust bearing 10. The thrust bearing 10 is rigidly connected to the ship's body 1. Universal joint shaft 7 is similar to the shaft interconnecting the drive motor and the gear unit and includes a rigid connecting shaft 8 with a universal joint 9 at each end of the shaft. As a result of this arrangement, it is possible to have relative movement between the gear unit and the thrust bearing. The thrust bearing serves to absorb axial forces which are generated by the propeller 5 during operation. Since the universal joint shaft 7 is equipped with constant velocity universal joints 9 it is not necessary for the axis 11 of the motor 2 and the axis 12 of the gear unit 3 to be in alignment or even parallel to one another. Moreover, it is not necessary for the axis 12 of the gear unit 3 and the axis 13 of the propeller shaft 4 to be in exact alignment, since in this arrangement as in the other shaft any non-uniform running movements are compensated by the universal joint shaft during operation. Such compensation is achieved, because the universal joint shaft 7 is able to accommodate axial movements in at least one of the universal joints 9. Any other displacements of the gear unit 3 are compensated by the angular movements in the joints.

Figure 2:
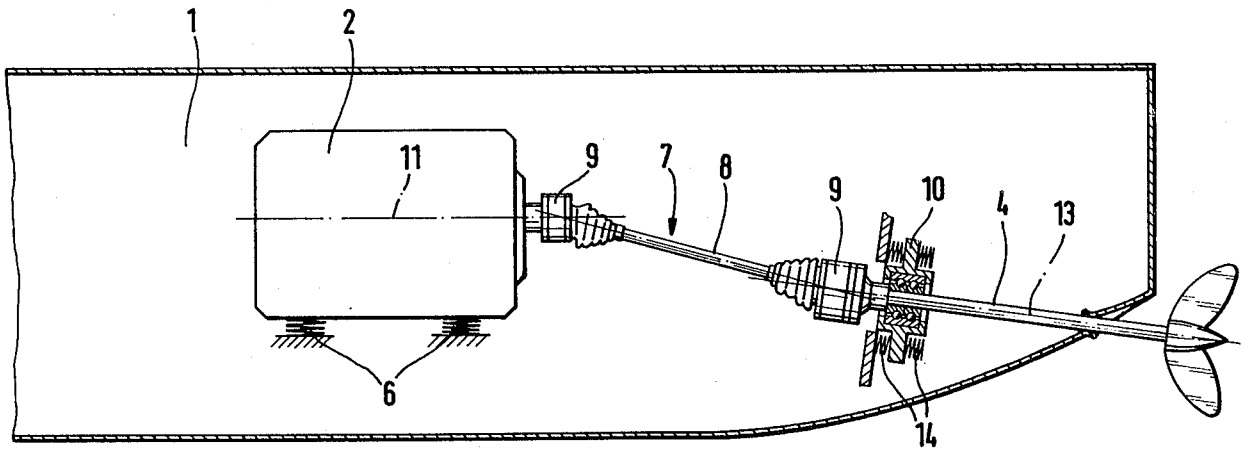
FIG. 2 is a schematic illustration similar to that in FIG. 1, however, the driving force is transmitted directly from the drive motor via a universal joint shaft to the propeller shaft.

In the ship's body 1 shown in FIG. 2, a drive motor 2 is flexibly mounted by elastic bearings 6. The driving force is transmitted directly from the drive motor 2 through a universal joint shaft 7 to a propeller shaft 4. As shown and described with regard to FIG. 1, the universal joint shaft consists of a rigid connecting shaft 8 with a constant velocity universal joint 9 at each of its ends. The propeller shaft 4 is connected through a thrust bearing 10 to the universal joint 9 on the adjacent end of the shaft 8. In this arrangement, the thrust bearing 10 is connected to the ship's body 1 by elastic bearings 14. Therefore, none of the components providing the driving action is rigidly connected to the ship's body 1. Accordingly, transmission of noise or vibration to the ship's body is prevented during operation. Further, in this arrangement, it is not necessary for the axis 11 of the drive motor 2 to be in alignment with the axis 13 of the propeller shaft 4 nor is it necessary that the axes be arranged in parallel. The compensating movements between the flexibly mounted components is absorbed in the joints 9 of the universal joint shaft 7.

Figure 4:
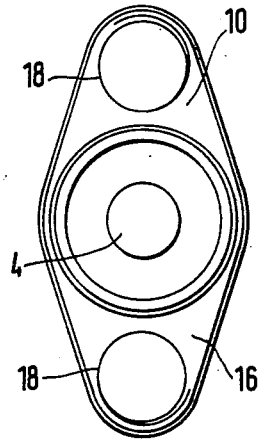
FIG. 4 is an end view of the thrust bearing as shown in FIG. 3.
Figure 3:
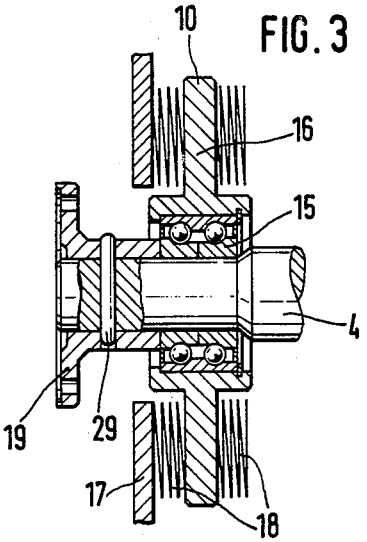
FIG. 3 is a sectional view of a flexibly mounted thrust bearing as shown in FIG. 2.

In FIGS. 3 and 4 the thrust bearing 10 employed in the drive arrangement of FIG. 2 is shown on an enlarged scale. The propeller shaft is received in and guided by a bearing 15. At its outer circumference, the bearing 15 is supported within a housing 16 and is flexibly mounted on the ship's body 1 via the housing 16 or a corresponding support member 17 of flexible bearing 18. The constant velocity universal joint 9 is fastened to the thrust bearing by means of a flange 19. When such a thrust bearing 10 is used, vibration or other axial running forces caused by the operation of the propeller 5 can be absorbed in the elastic bearings 18 of the thrust bearing 10 and the movements which take place and any vibrations generated are dampened and do not affect the smooth running operation of the ship itself. The ability to absorb unduly high torque without damaging the overall system is provided by means of a shear pin 29 extending between the propeller shaft 4 and the flange 19.

Figure 5:
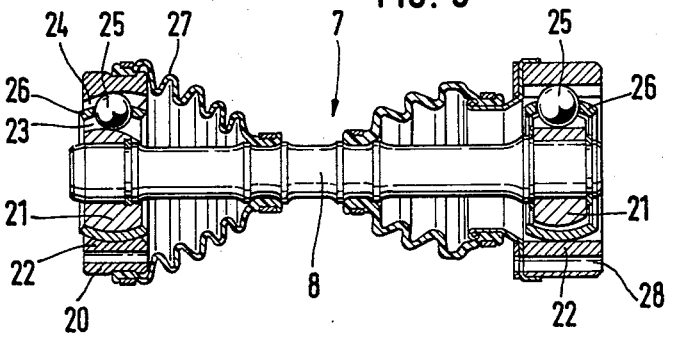
FIG. 5 is a sectional view of a universal joint shaft as shown in FIGS. 1 and 2.

The universal joint shaft 7 illustrated in FIG. 5 is made up of a rigid connecting shaft 8 with a constant velocity universal joint 20 at its left end. Joint 20 does not provide for axial movement, in other words, the inner joint member 21 and the outer joint member 22 do not move axially relative to one another, however, angular movements between these two members are possible. Grooves 23 are provided in the outer surface of the inner joint member 21 and a corresponding number of grooves 24 are provided in the inner hollow surface of the outer joint member 22 and balls 25 are seated within these grooves. The balls 25 transmit the torque within the joint and are held and guided by a cage 26. The interior of the joint is sealed from the atmosphere by a sealing boot 27.

At the opposite end of shaft 7 in FIG. 5 from the joint 20 is another joint 28 in which the inner joint member 21 is axially movable relative to the outer joint member 22. Accordingly, this right hand joint 28 can compensate both angular movement and axial movement. In this joint, balls 25 are provided for transmitting the torque and the balls are held in a cage 26. Balls 25 are positioned in grooves in the outer and inner joint members. Unlike joint 20, the hollow or concave inner surface of the outer joint member is cylindrical. On this cylindrical surface the cage 26 and the inner joint member 21 can be displaced axially via the rolling balls 25.

Figure 6:
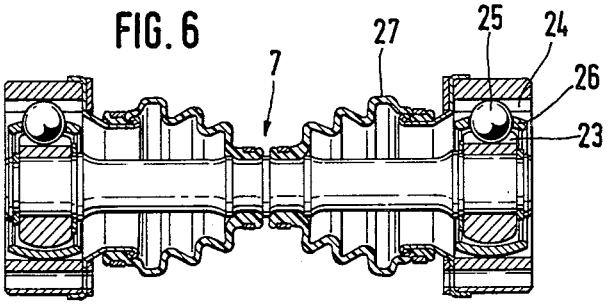
FIG. 6 is a universal joint shaft similar to that shown in FIG. 5, however, with the joints at each end of the shaft capable of absorbing axial movement.

In FIG. 6 another universal joint shaft 7 is illustrated, similar to that shown in FIG. 5, however, there is the difference that the joints at both ends of the shaft are capable of accommodating axial movement. These joints which provide for axial movement have been described in detail in FIG. 5. The arrangement in FIG. 6 provides the possibility that each of the joints compensates for half of the axial movement. Accordingly, the entire path of axial movement can be doubled. Universal joint shafts as shown in FIGS. 5 and 6 are capable of providing a uniform running operation even when the drive and driven shafts are not in alignment or in parallel relation. The uniformity of movement is achieved in that each of the balls within the joints is guided during angular movement over half the angle which is formed by the axis of the inner joint member and the axis of the outer joint member.

While specific embodiments of the invention have been shown and described in detail to illustrate the application of the inventive principles, it will be understood that the invention may be embodied otherwise without departing from such principles.

What is claimed is:

1. Drive arrangement for a ship comprising a drive unit, said drive unit including a drive motor, and at least a first drive shaft, a propeller shaft for driving a ship's propeller, said first drive shaft arranged to receive rotational driving force from said drive motor and connected to said propeller shaft for transmitting torque thereto for driving the propeller, wherein the improvement comprises means for individually flexibly mounting said drive motor within the ship, means for connecting said drive unit to said first drive shaft and said first drive shaft to said propeller shaft for providing uniform running operation and for permitting said drive motor of said unit and said propeller shaft to be positioned out of axial alignment, said first drive shaft comprises a rigid shaft, said connecting means comprises a constant velocity universal joint at each end of said rigid shaft with one said universal joint connecting said rigid shaft to said drive unit and the other said universal joint connecting said rigid shaft to said propeller shaft, with each of said universal joints being capable of absorbing angular movement and at least one of said universal joints being cable of absorbing relative axial movement therein.

2. Drive arrangement, as set forth in claim 1, wherein said rigid shaft is of a single length construction.

3. Drive arrangement, as set forth in claim 1, wherein a thrust bearing supports the end of said propeller shaft adjacent to said universal joint connecting said propeller shaft to said rigid shaft, and means for flexibly mounting said thrust bearing in the ship.

4. Drive arrangement, as set forth in claim 1, wherein said drive unit includes a gear unit, means for flexibly mounting said gear unit in the ship, a shaft interconnecting said drive motor and said gear unit and including a second drive shaft comprising a rigid shaft with one constant velocity universal joint connecting said rigid shaft to said drive motor and another constant velocity universal shaft connecting said rigid shaft to said gear unit, and said first drive shaft connecting said gear unit to said propeller shaft.

5. Drive arrangement, as set forth in claim 1, wherein said first drive shaft connects said drive motor to said propeller shaft.

6. Drive arrangement for a ship comprising a drive unit, said drive unit including a drive motor, and at least a first drive shaft, a propeller shaft for driving a ship's propeller, said first drive shaft arranged to receive rotational driving force from said drive motor and connected to said propeller shaft for transmitting torque thereto for driving the propeller, wherein the improvement comprises means for individually flexibly mounting said drive motor within the ship, means for connecting said drive unit to said first drive shaft and said first drive shaft to said propeller shaft for providing uniform running operation and for permitting said drive motor of said drive unit and said propeller unit to be positioned out of axial alignment, said first drive shaft comprises a rigid shaft of a single length construction, said connecting means arranged for connecting said rigid shaft to said drive unit and to said propeller shaft for affording angular movement between said rigid shaft and said drive unit and said propeller shaft and for affording axial movement between said rigid shaft and at least one of said drive unit and said propeller shafts, said connecting means comprises a constant velocity universal joint at each end of said rigid shaft with one said universal joint connecting said rigid shaft to said drive unit and the other said universal joint connecting said rigid shaft to said propeller shaft with each of said universal joints being capable of absorbing angular movement and at least one of said universal joints being capable of absorbing relative axial movement therein, and bearing support means for said propeller shaft located on said propeller shaft adjacent to said universal joint connecting said propeller shaft to said rigid shaft for flexibly mounting said propeller shaft in the ship.

* * * * *